United States Patent [19]

Peltre et al.

[11] 4,192,761

[45] Mar. 11, 1980

[54] DETERGENT COMPOSITIONS CONTAINING A SUDS REGULATING SYSTEM

[75] Inventors: Philippe Peltre, Paris; Alain Lafleur, Bretigny-sur-Orger, both of France

[73] Assignee: The Procter & Gamble Company, Cincinnati, Ohio

[21] Appl. No.: 917,444

[22] Filed: Jun. 20, 1978

[30] Foreign Application Priority Data

Jun. 23, 1977 [GB] United Kingdom ..... 26323/77

[51] Int. Cl.[2] ..... C11D 7/26; C11D 7/18

[52] U.S. Cl. ..... 252/99; 252/89.1; 252/174.25; 252/132; 252/135; 252/140; 252/321; 252/358; 252/539; 252/558

[58] Field of Search ..... 252/89 R, 99, 132, 135, 252/140, 163, 321, 358, 539, 558

[56] References Cited

U.S. PATENT DOCUMENTS

| | | | |
|---|---|---|---|
| 3,076,768 | 2/1963 | Boylan | 252/358 |
| 3,207,698 | 9/1965 | Liebling et al. | 252/531 |
| 3,399,144 | 8/1968 | Hathaway et al. | 252/99 |
| 3,408,306 | 10/1968 | Boylan II | 252/321 |
| 3,705,860 | 12/1972 | Duvall | 252/358 |
| 3,923,683 | 12/1975 | Michalski et al. | 252/321 |
| 3,933,672 | 1/1976 | Bartolotta et al. | 252/116 |
| 4,021,365 | 5/1977 | Sinka et al. | 252/321 |
| 4,056,481 | 11/1977 | Tate | 252/140 |
| 4,082,691 | 4/1978 | Berger | 252/358 |

FOREIGN PATENT DOCUMENTS

| | | |
|---|---|---|
| 2509508 | 9/1975 | Fed. Rep. of Germany . |
| 1465407 | 12/1966 | France . |
| 1489395 | 12/1967 | France . |

*Primary Examiner*—P. E. Willis, Jr.

[57] ABSTRACT

Detergent compositions having regulated suds over a broad range of usage and laundry temperature conditions containing an organic surface-active agent and a mixture of suds regulating components are disclosed. The suds regulating agent is a mixture of a liquid hydrocarbon in conjunction with an adjunct material, which can be a solid hydrocarbon or a fatty ester, and a hydrophobic silica suds regulating agent. The subject compositions are capable of providing effective and uniform suds regulating activity over the complete range of laundry temperatures from ambient temperature up to the boil and are generally independent of soil load, water hardness and other incidental factors known to interfere with the suds regulating activity.

17 Claims, No Drawings

DETERGENT COMPOSITIONS CONTAINING A SUDS REGULATING SYSTEM

BACKGROUND OF THE INVENTION

This invention pertains to detergent compositions having enhanced suds regulating activity over a broad range of usage and temperature conditions comprising a surface-active agent and a suds regulating system. The suds regulating system contains a liquid hydrocarbon, an adjunct material selected from solid hydrocarbons, fatty esters and mixtures thereof and a hydrophobic silica. The solid hydrocarbon adjunct material can be represented by species having a melting point in the range from about 45° C. to about 60° C. Preferred fatty esters can be fatty acid esters of mono- or polyhydric alcohols having from 1 to 8 carbon atoms in the alkyl chain.

The effective and uniform control of the quantity of suds formed during the laundry operation is a long-standing and well-known product formulation aspect which desires additional improvement. Excessive sudsing can affect the overall textile cleaning and fabric benefits frequently conferred by modern detergent compositions, particularly when the washing treatment is carried out in drum washing machines. Too much sudsing in the washing machine is undesirable because not only does it interfere with—diminish—the action of the laundry liquor upon the fabrics, but also residual suds in the washing machine can be carried over to the rinse cycle. This will not only increase the amount of suds in the rinse with the inherent difficulties of suppressing it but also can interfere with active-agents added to the rinsing step such as textile softeners.

As one could expect the prior art relative to detergent suds control is, commensurate with the efforts spent, very crowded and diverse. All the individual ingredients of the detergent compositions herein are well-known in the detergent art and have found application for various functions. U.S. Pat. No. 3,207,698 to Liebling et al., assigned to Nopco Chemical Company, discloses composition and method for defoaming aqueous systems wherein a hydrophobic precipitated silica having an alkaline pH is combined with a liquid hydrocarbon carrier. It is mentioned that the defoaming compositions are particularly well-suited for preventing and/or abating foam in aqueous system such as in concentrated and/or diluted black liquor systems produced during the alkaline pulping process, in latex paint systems and in acidic white water systems of the paper making process. German patent application DOS 23 35 468 discloses detergent compositions wherein a silicone/silica suds controlling agent is releasably incorporated into a water-soluble or water-dispersable, substantially non-surface-active, detergent-impermeable carrier. French Pat. No. 1.465.407 discloses detergent compositions having regulated suds wherein the regulating function is provided through the use of a hydrocarbon having a boiling point above about 90° C. in conjunction with a fatty acid having from 12 to 31 carbon atoms. The hydrocarbon can be represented by a 1:1 mixture of a liquid paraffin and a waxy paraffin. The suds regulant is incorporated into the detergent composition through slurrying with the other ingredients and spray-drying the slurry so obtained in a conventional manner. French Pat. No. 1.489.395 relates to detergent compositions having controlled suds through the use of a system containing essentially a fatty acid having from 12 to 18 carbon atoms in conjunction with a waxy hydrocarbon having a melting point below 100° C. The compositions according to the '395 patent are prepared by separately agglomerating the suds regulating mixture or by spraying the suds regulating agents onto the detergent base-powder. German patent application DOS 25 09 508 discloses detergent compositions capable of providing effective suds control through the combined use of a system comprising a micro-crystalline wax having a melting point of from 35° C. to 125° C. in combination with a suds suppressing amount of a silicone suds controlling agent releasably incorporated into a water-soluble or water-dispersable, substantially non-surface-active detergent impermeable carrier.

Notwithstanding the known shortcomings, prior art compositions could provide at premium cost acceptable suds regulating activity in commercial detergent products. However, known detergent suds regulating technology can be deficient inasmuch as it requires relatively high levels (>3%) of the regulant component(s) which levels can adversely affect the physical parameters of the finished product and the ease of manufacturing. From a performance point of view, known suds regulating systems can affect performance due to a functional deficiency in one or more of the following areas: decreased regulatory activity at temperatures in the range from about 75° C. up to the boil; decreased suds regulating activity in soft water; insufficient flexibility against stress conditions inclusive of low soil/high product usage and/or low water hardness; and no uniform control over the practical range of laundry temperatures extending from ambient temperature up to the boil. There is thus a standing desire for performance and additional reasons as set forth above to make available a robust suds regulating system capable of providing superior activity over the whole range of laundry conditions occurring in the treatments as, for example, carried out by housewives.

It is a main object of this invention to provide detergent compositions having effective and uniform suds control over the complete range of temperatures from ambient temperature up to the boil.

It is another object of this invention to provide detergent composition with effective and uniform suds control during the laundry operation under conditions of low water hardness.

It is still another object of this invention to provide detergent compositions having effective and uniform suds control under conditions of low soil and high product usage, possibly in presence of low hardness water.

The objectives set forth above and other advantages can now be obtained with the aid of the detergent compositions of this invention which are described in more detail hereinafter.

SUMMARY OF THE INVENTION

The present invention is based on the discovery that the suds regulating activity of detergent compositions containing an organic surface-active agent can be effectively and uniformly controlled with the aid of a multi-component suds regulating system. Significantly improved suds control over a wide range of laundry conditions can be obtained through the use of the subject compositions. In addition to avoiding the direct inconveniences of over-sudsing during the laundry operation, these compositions are capable of providing superior textile cleaning and other textile benefits.

The compositions of this invention comprise an organic surface-active agent and a multi-component suds regulating system. More specifically, the compositions herein comprise from about 2% to about 70% by weight of an organic surface-active agent; and from 0.01% to about 5% by weight of a suds regulating system comprising:

A. from 99.9% to about 75% by weight of the suds regulating system of a mixture consisting of i. from about 30% to about 98% by weight of a substantially water-insoluble liquid, at room temperature and atmospheric pressure, hydrocarbon; and ii. from about 70% to about 2% by weight of an adjunct material selected from the group of:

1. a substantially water-insoluble solid hydrocarbon having a melting point in the range from about 35° C. to about 110° C.;
2. a fatty ester of mono- or polyhydric alcohols having from 1 to about 40 carbon atoms in the hydrocarbon chain, and mono- or polycarboxylic acids having from 1 to about 40 carbon atoms in the hydrocarbon chain with the provisos that the total number of carbon atoms in the ester is equal to or greater than 16 and that at least one of the hydrocarbon radicals in the ester has 12 or more carbon atoms; and
3. mixtures thereof.

B. from 0.1% to about 25% by weight of the suds regulating system of a hydrophobic silica suds regulating agent.

In a preferred aspect of this invention the detergent compositions additionally can comprise from about 3% to about 50% by weight of a detergent builder component.

DETAILED DESCRIPTION OF THE INVENTION

The compositions of the present invention comprise an organic surface-active agent and a multi-component suds regulating system. The suds regulating system is comprised of a liquid hydrocarbon, an adjunct material selected from a solid hydrocarbon and a fatty ester and a hydrophobic silica suds regulating agent. These individual components are described in more detail hereinafter.

Unless specified to the contrary, the "%" indications stand for percent by weight.

A first essential component herein is an organic surface-active agent which can be used in an amount from about 2% to about 70%, preferably from 3% to about 50%. Suitable organic surface-active agents herein can be represented by active ingredients which are known to meet the requirements for use in and/or have already been used in detergent compositions. Exemplifying species for use herein can be selected from the group of anionic, nonionic, ampholytic, zwitterionic, and cationic surfactants and mixtures thereof.

Examples of suitable nonionic surfactants include:

(1) The polyethylene oxide condensates of alkyl phenols. These compounds include the condensation products of alkyl phenols having an alkyl group containing from about 6 to 12 carbon atoms in either a straight chain or branched chain configuration, with ethylene oxide, the said ethylene oxide being present in amounts equal to 5 to 25 moles of ethylene oxide per mole of alkyl phenol.

(2) The condensation products of aliphatic alcohols with ethylene oxide. The alkyl chain of the aliphatic alcohol may either be straight or branched and generally contains from about 8 to about 22 carbon atoms. Examples of such ethoxylated alcohols include the condensation product of about 6 moles of ethylene oxide with 1 mole of tridecanol, myristyl alcohol condensed with about 10 moles of ethylene oxide per mole of myristyl alcohol, the condensation product of ethylene oxide with coconut fatty alcohol wherein the coconut alcohol is a mixture of fatty alcohols with alkyl chains varying from 10 to 14 carbon atoms and wherein the condensate contains about 6 moles of ethylene oxide per mole of alcohol, and the condensation product of about 9 moles of ethylene oxide with the above-described coconut alcohol.

(3) The condensation products of ethylene oxide with the product resulting from the reaction of propylene oxide and ethylene diamine. The condensation product frequently contains from about 40 to about 80% by weight of polyoxyethylene and has a molecular weight of from about 5,000 to about 11,000.

(4) Amine oxide surfactants inclusive of dimethyldodecylamine oxide, dimethyltetradecylamine oxide, ethylmethyltetradecylamine oxide, cetyldimethylamine oxide, dimethylstearylamine oxide, cetylethylpropylamine oxide, diethyldodecylamine oxide, and diethyltetradecylamine oxide.

(5) Suitable phosphine oxide detergents include: dimethyldodecylphosphine oxide, dimethyltetradecylphosphine oxide and ethylmethyltetradecylphosphine oxide; suitable sulfoxide surfactants include octadecylmethyl sulfoxide, dodecylmethyl sulfoxide and tetradecylmethyl sulfoxide.

Examples of suitable ampholytic synthetic detergents are sodium 3-(dodecylamino)propionate, and sodium 3-(dodecylamino)propane-1-sulfonate.

Zwitterionic surfactants for use herein include 3-(N,N-dimethyl-N-hexadecylammonio)-2-hydroxypropane-1-sulfonate, 3-(N,N-dimethyl-N-aikylammonio)-2-hydroxypropane-1-sulfonate, the alkyl group being derived from tallow fatty alcohol; 3-(N,N-dimethyl-N-hexadecylammonio)propane-1-sulfonate; 3-(N,N-dimethyl-N-tetradecylammonio)propane-1-sulfonate; and 3-(N,N-dimethyldodecylammonio)-2-hydroxypropane-1-sulfonate.

Suitable anionic detergents include ordinary alkali metal soaps of higher fatty acids containing from about eight to about 24 carbon atoms and preferably from about 10 tc about 20 carbon atoms.

Alkyl sulfonated or sulfated surfactants inclusive of alkyl benzene sulfonates, in which the alkyl group contains from about 9 to about 20 carbon atoms in straight-chain or branched-chain configuration, e.g., those of the type described in U.S. Pat. Nos. 2,220,099 and 2,477,383 (especially valuable are linear straight chain alkyl benzene sulfonates in which the average of the alkyl groups is about 11.8 carbon atoms and commonly abbreviated as $C_{11.8}$LAS); sodium alkyl glyceryl ether sulfonates, especially those ethers of higher alcohols derived from tallow and coconut oil; sodium coconut oil fatty acid monoglyceride sulfonates and sulfates.

Useful in this invention are also salts of 2-acyloxyalkane-1-sulfonic acids.

Typical examples of the 2-acyloxy-alkanesulfonates are described in Belgium Pat. No. 650,323 issued July 9, 1963, U.S. Pat. Nos. 2,094,451 issued Sept. 28, 1937, to Guenther et al. and 2,086,215 issued July 6, 1937 to DeGroote; these references are hereby incorporated by reference.

β-alkyloxy alkane sulfonates can also be used. Specific examples of β-alkyloxy alkane sulfonates having low hardness (calcium ion) sensivity useful herein to provide superior cleaning levels under household washing conditions include: potassium-β-methoxydecanesulfonate, sodium 2-methoxytridecanesulfonate, potassium 2-ethoxytetradecylsulfonate, and sodium 2-isopropoxyhexadecylsulfonate.

Paraffin sulfonates containing a straight or branched chain, saturated aliphatic hydrocarbon radical having from 8 to 24, preferably 12 to 18, carbon atoms can also be used.

Other synthetic anionic detergents useful herein are alkyl ether sulfates. These materials have the formula $RO(C_2H_4O)_xSO_3M$ wherein R is alkyl or alkenyl of about 10 to about 20 carbon atoms, x is 1 to 30, and M is a water-soluble cation.

Suitable examples of alkyl ether sulfates are those comprising a mixture of individual compounds, said mixture having an average alkyl chain length of from about 12 to 16 carbon atoms and an average degree of ethoxylation of from about 1 to 4 moles of ethylene oxide. Such a mixture also comprises from about 0 to 20% by weight $C_{12-13}$ compounds; from 60 to 100% by weight of $C_{14-15-16}$ compounds; from about 0 to 20% by weight of $C_{17-18-19}$ compounds; from about 3 to 30% by weight of compounds having a degree of ethoxylation of 0; from about 45 to 90% by weight of compounds having a degree of ethoxylation of from 1 to 4; from about 10 to 25% by weight of compounds having a degree of ethoxylation of from 4 to 8; and from about 0.1 to 15% by weight of compounds having a degree of ethoxylation greater than 8.

α-Olefin sulfonate mixtures as described in U.S. Pat. No. 3,332,880, issued July 25, 1967, incorporated herein by reference, can also be used.

Cationic surface-active agents inclusive of di($C_{12}$-$C_{20}$)alkyl, di($C_{1-4}$)alkyl ammonium halides, and imidazolinium derivatives can also be used in the compositions herein.

The ternary suds regulating system herein is particularly effective in presence of anionic and/or nonionic surfactants. Frequently, these anionic and/or nonionic surfactants are present in the compositions of this invention in a level from about 5% to about 20%.

A second essential component herein is represented by a suds regulating system which is used in an amount from 0.01% to about 5%. The suds regulating system comprises a liquid hydrocarbon, an adjunct material selected from a solid hydrocarbon having a melting point from about 35° C. to about 110° C.; a fatty ester of mono- or polyhydric alcohols having from 1 to about 40 carbon atoms in the hydrocarbon chain, and mono- or polycarboxylic acids having from 1 to about 40 carbon atoms in the hydrocarbon chain, and mixtures thereof; and a hydrophobic silica suds regulating agent. From 99.9% to about 75%, preferably from about 99.5% to about 90% of the suds regulating system is represented by the mixture of the liquid hydrocarbon and the adjunct material. The liquid hydrocarbon represents from about 30% to about 98% of the liquid hydrocarbon/adjunct material mixture, while the adjunct material represents from about 70% to about 2% of said mixture of liquid hydrocarbon/adjunct material.

The hydrocarbon components suitable for use in the practice of this invention may be any aliphatic, alicylic, aromatic or heterocyclic saturated or unsaturated hydrocarbons having generally from about 12 to about 70 carbon atoms. Paraffins are preferred hydrocarbons herein. Paraffins are generally obtained from petroleum by various methods inclusive of fractionation distillation, solvent extraction, cracking, reforming or polymerization of lower olefines or diolefines. Paraffin can also be synthesized from coal thereby using the Fischer-Tropsch process, or by hydrogenation of unsaturated hydrocarbons. Paraffins are preferably obtained by distillation or solvent extracting the solid residus of petroleum distillation.

The liquid, at room temperature and atmospheric pressure, hydrocarbon herein has normally a pour point in the range of −40° C. to 5° C. and usually contains from 12 to 40 carbon atoms. The liquid hydrocarbon should normally have a minimum boiling point of not less than 110° C. (at atmospheric pressure). Liquid paraffins, preferably of the naphthenic or paraffinic type, also known as mineral white oil are preferred.

The adjunct material hydrocarbon has a melting point in the range from about 35° C. to about 110° C. and comprises generally from 12 to 70 carbon atoms. Preferred solid hydrocarbon species have a melting point from about 45° C. to about 60° C. Other preferred solid hydrocarbon species herein have a melting point from 80° C. to 95° C. Preferred hydrocarbon adjunct materials are petroleum waxes of the paraffin and microcrystalline type which are composed of long-chain saturated hydrocarbon compounds. The hydrocarbon adjunct material is preferably used in an amount from about 40% to about 2% of the mixture of liquid hydrocarbon and hydrocarbon adjunct material. The liquid hydrocarbon component represents preferably from about 60% to about 98% of the mixture of liquid hydrocarbon and hydrocarbon adjunct material.

The adjunct material can also be represented by a fatty ester of mono- or polyhydric alcohols having from 1 to about 40 carbon atoms in the hydrocarbon chain, and mono- or polycarboxylic acids having from 1 to about 40 carbon atoms in the hydrocarbon chain with the provisos that the total number of carbon atoms in the ester is equal to or greater than 16 and that at least one of the alkyl radicals in the ester has 12 or more carbon atoms. The fatty ester is preferably used in an amount from about 10% to about 70% of the mixture of liquid hydrocarbon and fatty ester adjunct material. The liquid hydrocarbon component represents preferably from about 30% to about 90% of the mixture of liquid hydrocarbon and fatty ester adjunct material.

The fatty ester adjunct material can be of natural or synthetic origin. Examples of suitable natural fatty esters herein include: beeswax from honeycombs which consists chiefly of the esters $CH_3(CH_2)_{24}COO(CH_2)_{27}CH_3$ and $CH_3(CH_2)_{26}COO(CH_2)_{25}CH_3$; carnauba wax from the Brazilian palm which is a mixed ester containing principally $C_{31}H_{63}COOC_{32}H_{65}$ and $C_{33}H_{67}COOC_{34}H_{69}$; and spermaceti (wax) from the sperm whale which is mainly $C_{15}H_{31}COOC_{16}H_{33}$.

The fatty acid portion of the fatty ester can be obtained from mono- or poly-carboxylic acids having from 1 to about 40 carbon atoms in the hydrocarbon chain. Suitable examples of monocarboxylic fatty acids include behenic acid, stearic acid, oleic acid, palmitic acid, myristic acid, lauric acid, acetic acid, propionic acid, butyric acid, isobutyric acid, valeric acid, lactic acid, glycolic acid and β,β'-dihydroxy-isobutyric acid.

Examples of suitable polycarboxylic acids include: n-butyl-malonic acid, isocitric acid, citric acid, maleic acid, malic acid, and succinic acid.

The fatty alcohol radical in the fatty ester can be represented by mono- or polyhydric alcohols having from 1 to 40 carbon atoms in the hydrocarbon chain. Examples of suitable fatty alcohols include: behenyl, arachidyl, cocoyl, oleyl and lauryl alcohol, ethylene glycol, glycerol, ethanol, isopropanol, vinyl alcohol, diglycerol, xylitol, sucrose, erythritol, pentaerythritol, sorbitol or sorbitan.

Preferably, the fatty acid and/or fatty alcohol group of the fatty ester adjunct material have from 1 to 24 carbon atoms in the alkyl chain.

Preferred fatty esters herein are ethylene glycol, glycerol and sorbitan esters wherein the fatty acid portion of the ester normally comprises a species selected from behenic acid, stearic acid, oleic acid, palmitic acid or myristic acid.

Sorbitol, prepared by catalyst hydrogenation of glucose, can be dehydrated in well-known fashion to form mixture of 1,4 and 1,5-sorbitol anhydrides and small amounts of isosorbides. (See Brown, U.S. Pat. No. 2,322,821, issued June 29, 1943). This mixture of sorbitol anhydrides is collectively referred to as sorbitan. The sorbitan mixture will also contain some free, uncyclized sorbitol.

Sorbitan esters useful herein can be prepared by esterifying the "sorbitan" mixture with a fatty acyl group in standard fashion, e.g., by reaction with a fatty acid halide or fatty acid. The esterification reaction can occur at any of the available hydroxyl groups, and various mono-, di-, etc., esters can be prepared. In fact, mixtures of mono-, di-, tri-, etc., esters almost always result from such reactions. Esterified hydroxyl groups can, of course, be either in terminal or internal positions within the sorbitan molecule.

It is also to be recognized that the sorbitan esters employed herein can contain up to about 15% by weight of esters of the $C_{20}$-$C_{26}$, and higher, fatty acids, as well as minor amounts of $C_8$, and lower, fatty esters. The presence or absence of such contaminants is of no consequence in the present invention.

The glycerol esters are also highly preferred. These are the mono-, di- or tri-esters of glycerol and the fatty acids as defined above.

Specific examples of fatty alcohol esters for use herein include: stearyl acetate, palmityl di-lactate, cocoyl isobutyrate, oleyl maleate, oleyl di-maleate, and tallowyl proprionate. Fatty acid esters useful in the present invention include: xylitol monopalmitate, pentaerythritol monostearate, sucrose monostearate, glycerol monostearate, ethylene glycol monostearate and sorbitan esters. Suitable sorbitan esters include sorbitan monostearate, sorbitan palmitate, sorbitan monolaurate, sorbitan monomyristate, sorbitan monobehenate, sorbitan monooleate, sorbitan dilaurate, sorbitan disterate, sorbitan dibehenate, sorbitan dioleate, and also mixed tallowalkyl sorbitan mono- and di-esters. Glycerol esters are equally highly preferred in the composition herein. These are the mono-, di-, or tri-esters of glycerol and the fatty acids of the class described above. Glycerol monostearate, glycerol mono-oleate, glycerol monopalmitate, glycerol monobehenate, and glycerol distearate are specific examples of these preferred glycerol esters.

The fatty esters in the suds regulating system herein must contain a number of carbon atoms equal to or greater than 16; normally, suitable fatty esters contain at least one alkyl radical having 12 or more carbon atoms.

The adjunct material can also be represented by a mixture of the adjunct solid hydrocarbon and the adjunct fatty ester. Such adjunct material mixtures preferably contain the adjunct hydrocarbon to adjunct fatty ester in a weight ratio of hydrocarbon:ester from 1:20 to 1:1, more preferably from 1:2 to 1:10.

Another essential component herein is a hydrophobic silica suds regulating about which is used in an amount from 0.1% to about 25%, preferably from 0.5% to about 10% of the suds regulating system i.e. containing the liquid hydrocarbon, the adjunct material and the silica.

Suitable silica suds regulating agents herein are microfine, hydrophobic, particulate silicas. These silicas usually have an average primary particle diameter from about 5 millimicrons (m$\mu$) to about 100 m$\mu$, preferably from 10 m$\mu$ to 30 m$\mu$. The primary particles can form aggregates—frequently termed secondary particles—having frequently an average particle diameter in the range from about 0.3$\mu$ to about 3$\mu$. Suitable silica components can additionally be characterized by a specific surface area from about 50 $m^2/g$ to about 400 $m^2/g$, preferably from 100 $m^2/g$ to 200 $m^2/g$. The specific surface area can be determined with the aid of the $N_2$-adsorption method. The preferred silica component herein can additionally be defined in having a pH in the range from 8 to 12, to thus be better compatible with the usually alkaline laundry solution. Generally preferred herein are precipitated hydrophobic microfine silicas with preferred species are commercially available under the trade names QUSO WR82 and QUSO WR50 from Philadelphia QUARZ Company. Additional examples of suitable silicas herein can include pyrogenic silica and aerogel and xerogel silicas provided their general physical properties are as set forth above. The silica can be rendered hydrophobic through one of the well-known treatments such as e.g. disclosed in U.S. Pat. No. 3,207,698, or UK Patent Application No. 10734/74 of Mar. 11, 1974.

The silica component can be used as such or in conjunction with other compounds such as silicones. Suitable silica/silicone mixtures are commercially available from DOW CORNING Comp.; the silica can be physically or chemically bond to part or all of the silicone fluid. In such silica/silicone mixtures, the silica frequently represents up to about 50%, preferably from 5% to 20% of the mixture of silica and silicone.

The detergent composition of the instant invention frequently contains as an optional ingredient a detergent builder in a level from about 3% to about 50%. Useful builders herein include any of the conventional inorganic and organic water-soluble builder salts as well as various water-insoluble and so-called "seeded" builders.

Detergency builder salts useful herein can be of the polyvalent inorganic and polyvalent organic types, or mixtures thereof. Non-limiting examples of suitable water-soluble, inorganic alkaline detergency builder salts include the alkali metal carbonates, borates, phosphates, polyphosphates, tripolyphosphates, bicarbonates, silicates, and sulfates. Specific examples of such salts include the sodium and potassium tetraborates, bicarbonates, carbonates, tripolyphosphates, pyrophosphates, and hexametaphosphates.

Examples of suitable organic alkaline detergency builder salts are: (1) water-soluble amino polyacetates, e.g. sodium and potassium ethylenediaminetetraacetates, nitrilotriacetates, and N-(2-hydroxyethyl)nitrilodiacetates; (2) water-soluble salts of phytic acid, e.g. sodium and potassium phytates; (3) water-soluble polyphosphonates, including sodium, potassium and lithium salts of ethane-1-hydroxy-1,1-diphosphonic acid; sodium, potassium, and lithium salts of methylenediphosphonic acid and the like. Additional organic builder salts useful herein include the polycarboxylate materials described in U.S. Pat. No. 2,264,103, including the water-soluble alkali metal salts of mellitic acid. The water-soluble salts of polycarboxylate polymers and copolymers such as are described in U.S. Pat. No. 3,308,067, incorporated herein by reference, are also suitable herein.

It is to be understood that while the alkali metal salts of the foregoing inorganic and organic polyvalent anionic builder salts are preferred for use herein from an economic standpoint, the ammonium, alkanolammonium (e.g. triethanolammonium, diethanolammonium and monoethanolammonium) and other water-soluble salts of any of the foregoing builder anions can also be used.

Mixtures of organic and/or inorganic builders can be used herein. One such mixture of builders is disclosed in Canadian Pat. No. 755,038, e.g. a ternary mixture of sodium tripolyphosphate, trisodium nitrilotriacetate, and trisodium ethane-1-hydroxy-1,1-diphosphonate.

A further class of builder salts is the water-insoluble alumino silicate type which functions by cation exchange to remove polyvalent mineral hardness and heavy metal ions from solution. A preferred builder of this type has the formulation $Na_z(AlO_2)_z(SiO_2)_y.xH_2O$ wherein z and y are integers of at least 6, the molar ratio of z to y is in the range from 1.0 to about 0.5 and x is an integer from about 15 to about 264. Compositions incorporating builder salts of this type form the subject of British Patent Specification No. 1,429,143 published Mar. 24, 1976, German Patent Application No. OLS 24 33 485 published Feb. 6, 1975, and OLS 25 25 778 published Jan. 2, 1976, the disclosures of which are incorporated herein by reference.

Another type of detergency builder material useful in the present invention comprises a water-soluble material capable of forming a water-insoluble reaction product with water hardness cations, preferably in combination with a crystallization seed which is capable of providing growth sites for said reaction product. Specific examples of materials capable of forming the water-insoluble reaction product include the water-soluble salts of carbonates, bicarbonates, sesquicarbonates, silicates, aluminates and oxalates. The alkali metal, especially sodium, salts of the foregoing materials are preferred for convenience and economy. Preferred crystallization seed materials are calcium carbonate, calcium oxide and calcium hydroxide. Such "seeded builder" compositions are fully disclosed in British Patent Specification No. 1,424,406, incorporated herein by reference.

Non-seeded precipitating builder systems employing pyrophosphates or mixtures thereof with orthophosphates are also useful herein. Precipitating pyrophosphate and ortho-pyrophosphatesbuilder systems are disclosed in German Patent Applications OLS No. 25 42 704 and 26 05 052 published Apr. 15 and Aug. 16, 1976, respectively and British Patent Application No. 76-33786 filed Aug. 13, 1976, which are specifically incorporated herein by reference.

In addition to the components described hereinbefore, the compositions of this invention can comprise a series of supplementary components to perfect and complement the performance advantages derivable from the combination of essential components. These additional components include brighteners, dyes, perfumes, bactericides, processing aids, anti-oxidants, corrosion inhibitors, enzymes and so on.

It may be desirable to add a copolymer of a (1) vinyl compound having the general formula RCH=CHR wherein one R represents a hydrogen atom and the other R represents an alkyl radical containing from one to about 4 carbon atoms; and (2) maleic anhydride. The copolymeric vinyl ingredient is normally used in an amount from about 0.1% to about 6%, preferably from 0.25% to 4%. Specific examples of these copolymeric ingredients include a water-soluble acid, an alkali-metal salt of that acid, an ester, or a $C_{1-2}$ alkyl— or alkylolamide of a maleic anhydride-vinyl $C_{1-4}$ alkyl ether copolymer. The specific viscosity of, for example, the maleic anhydride-vinyl $C_{1-4}$ alkyl ether, preferably methylether, copolymer for use herein normally varies between 0.1 and 6, most preferably between 0.2 and 5.0. The (molecular) monomer ratio (maleic:vinylalkylether) is preferably in the range from 2:1 to 1:2. The specific viscosity is defined by measuring the viscosity of the solution of 1 g of the anhydride copolymer in 100 ml methylethylketone at 25° C. in a series 100 CANNON-FENSKE viscosity meter. The copolymeric component can serve as slurry processing aid to thus provide a detergent product having improved physical properties including flowability.

Another optional ingredient is a mixture of alkoxylated mono- and diesters of phosphoric acid. This mixture which is normally used in an amount from 0.5% to 20% by reference to the sum of the surface-active agents, is particularly useful in detergent compositions containing, in part or solely, nonionic surface-active agents. These phosphoric esters are preferably represented by alkoxylated fatty alcohols having from 10 to 22 carbon atoms with 2 to 15 moles ethylene oxide or propylene oxide. The weight ratio of monophosphoric esters to diphosphoric esters is usually in the range from 6:1 to 3:1, preferably 4:1.

It may be desirable, especially if nonionic surfactants are incorporated by slurrying and subsequent spray-drying, to add to the crutcher from 0.01% to 10%, expressed by reference to the nonionic surfactant of, an anti-oxidant. Suitable examples of anti-oxidant materials are disclosed in German patent application DAS 1,617,209. A preferred anti-oxidant material is 4,4'-thiobis(6-tert-butyl-m-cresol).

The detergent composition can additionally contain an enzymatic ingredient. Proteases, amylases and lipases can be added in an amount from 0.001% to about 5% to augment and aid in the cleaning activity of the bleaching detergent compositions herein. Preferred proteolytic enzymes are disclosed in Belgian Pat. No. 775.854, to EYMERY et al., granted May 26, 1972.

The granular compositions of this invention can also advantageously contain a peroxy-bleach component in an amount from about 3% to about 50%, preferably from about 8% to about 35%. Examples of suitable peroxybleach components herein include perborates, persulfates, persilicates, perphosphates, percarbonates and more in general all inorganic and organic peroxy-bleaching agents which are known to be adapated for use in the subject compositions. Organic oxygen-bleach activators can also advantageously be used in oxygen-bleach detergent compositions. Examples of such activators include phthalic anhydride, tetraacetyl ethylenediamine, tetraacetyl methylenediamine, and tetraacetyl glycouril. These activators produce in the laundry liquor organic peroxy-acids which have enhanced low temperature bleach performance. Activators of this type are normally used with sodium perborate at usage levels from about 0.5% to 15%, preferably from 3% to 7%.

The multi-component suds regulating mixture of this invention can be added to the additional detergent ingredients by all conventional means known to be satisfactory for that purpose. For example, either one of the materials can be incorporated into the slurry and subsequently spray dried to a granular composition or they can be added separately to the other detergent composition ingredients which have been granulated separately. In a preferred manufacturing aspect, a melt of the multi-component suds regulating system of this invention is sprayed onto the detergent base-powder granule or the individually prepared detergent granule. This implies that the silica suds regulating agent is pre-mixed with a melt containing the adjunct material and the liquid hydrocarbons of this invention. It is also possible to individually agglomerate the components of the suds regulating system with one or more individual components of the detergent system followed by mixing the agglomerate containing the suds regulant with the detergent base-powder.

EXAMPLES

A granular detergent base-powder having the composition listed hereinafter was prepared by conventional spray-drying of a slurry of the individual ingredients.

| INGREDIENTS | PARTS BY WEIGHT |
|---|---|
| Linear dodecyl benzene sulfonate Sodium salt | 9.0 |
| Condensation product of one mole of tallow alcohol and 11 moles of ethylene oxide | 0.5 |
| sodium tripolyphosphate | 35 |
| Sodium silicate solids ($SiO_2$:$Na_2O$ = 2) | 6 |
| Carboxymethylcellulose | 1 |
| Sodium sulfate | 16 |
| Moisture | 7 |

A series of spray-drying sensitive ingredients were added to the above base-powder by dry-mixing, namely:

| | |
|---|---|
| Perborate tetrahydrate | 25 |
| Enzyme | 0.4 |
| Minors inclusive of perfume | 2.5 |

The suds regulating mixture as defined below was added to the above oxygen-bleach containing detergent. The levels of the suds regulating components define the quantity of each individual species to be added to 100 parts of the oxygen-bleach containing detergent composition.

| | SUDS REGULATING SYSTEM (in parts by weight) | | | | | |
|---|---|---|---|---|---|---|
| EXAMPLE | LIQUID HYDROCARBON | | ADJUNCT MATERIAL | | SILICA | |
| I | Paraffin oil[2] | 0.8 | Paraffin wax MP:52°-54° C. | 0.125 | Silica[1] (QUSO WR 82) | 0.07 |
| II | " | 0.8 | Paraffin wax MP:52°-54° C. | 0.125 | Silica pre-agglomerated[3] | 0.01 |
| III | " | 1.0 | Paraffin wax MP:52°-54° C. | 0.156 | Silica pre-agglomerated[3] | 0.01 |
| IV | " | 0.8 | Paraffin wax MP:52°-54° C. | 0.125 | Silica pre-agglomerated[3] | 0.003 |
| V | " | 0.8 | Glycerol mono-stearate | 1.0 | Silica pre-agglomerated[3] | 0.003 |
| VI | " | 0.8 | Microcrystalline wax-MP:85° C. | 0.025 | Silica pre-agglomerated[3] | 0.01 |
| VII | " | 0.8 | Paraffin wax MP:52°-54° C. Glycerol mono-stearate | 0.125 0.25 | Silica (QUSO WR 82) | 0.003 |
| Reference (a) | — | — | Microcrystalline wax-MP:85° C. | 0.025 | Silica pre-agglomerated | 0.01 |
| (b) | — | — | Microcrystalline wax-MP:85° C. | 0.3 | Silica pre-agglomerated | 0.01 |
| (c) | Paraffin oil | 0.8 | — | — | Silica pre-agglomerated | 0.01 |
| (d) | — | — | Paraffin wax MP:50° C. | 0.125 | Silica pre-agglomerated | 0.01 |
| (e) | — | — | Glycerol mono-stearate | 1.0 | Silica pre-agglomerated | 0.003 |

[1]Microfine-precipitated hydrophobic silica supplied by Philadelphia QUARTZ Co.
[2]Supplied by MERCK (Germany) Ref: 7162
[3]Preagglomerated mixture of silicone/silica and sodium tripolyphosphate The compositions according to this invention I thru VII exhibited excellent suds-control under various usage conditions inclusive of temperatures from ambient up to the boil and under low soil/high product usage conditions; whereas the reference compositions did not provide effective control over the same wide range of conditions.

Substantially similar results are obtained from varying the level of the preagglomerated silica in example I from (in parts by weight) 0.07 to 0.003; 0.03; and 0.1 respectively.

Substantially comparable results can also be obtained in substituting the glycerol monostearate in example VII by an equivalent amount of an adjunct material selected from: beeswax; carnauba wax; spermaceti; stearyl acetate; palmityl di-lactate; cocoyl isobutyrate; oleyl maleate; oleyl di-maleate; tallowylpropionate; xylitol monopalmitate; pentaerythritol monostearate; sucrose monostearate; ethylene glycol monostearate; sorbitan monostearate; sorbitan monomyristate; sorbitan monobehenate; sorbitan di-stearate; sorbitan di-myristate; sorbitan di-behenate and sorbitan di-oleate.

Detergent compositions are prepared in a conventional manner comprising the following ingredients.

| INGREDIENTS | COMPOSITION IN PARTS BY WEIGHT EXAMPLES VIII | IX | X | XI |
|---|---|---|---|---|
| Linear dodecylbenzene sulfonate sodium salt | 6 | 5 | 8 | 15 |
| Condensate of $C_{14-15}$ alcohol blend, molar ratio $C_{14}$:$C_{15}$ = 1:1, with 9 moles of ethylene oxide per mole of alcohol | 3 | 8 | — | 15 |
| Condensate of $C_{14-15}$ alcohol blend, molar ratio $C_{14}$:$C_{15}$ = 1:1, with 3 moles of ethylene oxide per mole of alcohol | — | 3 | 4 | — |
| Sodium perborate . 4 . $H_2O$ | 20 | 25 | 20 | 10 |
| Condensate of one mole tallow alcohol and 11 moles of ethylene oxide | — | — | 3 | — |
| Enzyme | 0.4 | 0.4 | 0.8 | 0.5 |
| Sodiumtripolyphosphate | 30 | 10 | 20 | — |
| Water-insoluble alumino-silicate builder[4] | — | 20 | 10 | 20 |
| Copolymer of maleic anhydride and vinylmethylether, monomer ratio 1:1; specific viscosity at 25° C. from 0.6 to 6.0 | — | 1.0 | 1.0 | 1.5 |
| Sodium sulfate | 20 | 20 | 20 | 26 |
| Paraffin oil | 1.2 | 0.4 | 0.4 | 2 |
| Paraffin MP:50–55° C. | 0.18 | 0.06 | 0.04 | 0.1 |
| Silica, microfine, hydrophobic | 0.01 | 0.03 | 0.10 | 0.03 |
| Glycerol monostearate | — | 0.3 | 0.2 | — |
| Minors and moisture | | balance to 100 | | |

[4]ZEOLITE A having the formula $Na_{12}(AlO_2)_{12}(SiO_2)_{12}$ . $27H_2O$ having an average particle diameter of 2.2 microns.

-continued

| INGREDIENTS | EXAMPLES XII | XIII | XIV |
|---|---|---|---|
| Minors – moisture | | balance to 100 | |

(5)ZEOLITE A having the formula under (4) above and an average particle diameter of 1.8 microns.

What is claimed is:

1. A granular detergent composition having superior suds regulating capacity over a broad range of usage conditions comprising: from about 2% to about 70% by weight of an organic surface-active agent; and from 0.01% to about 5% by weight of a suds regulating system comprising:

A. from 99.9% to about 75% by weight of the suds regulating system of a mixture consisting of i. from about 30% to about 98% by weight of a substantially water-insoluble liquid, at room temperature and atmospheric pressure, hydrocarbon; and ii. from about 70% to about 2% by weight of an adjunct material selected from the group of:

1. a substantially water-insoluble solid hydrocarbon having a melting point in the range from about 35° C. to about 110° C.;

2. a fatty ester of mono- or polyhydric alcohols having from 1 to about 40 carbon atoms in the hydrocarbon chain, and mono- or polycarboxylic acids having from 1 to about 40 carbon atoms in the hydrocarbon chain with the provisos that the total number of carbon atoms in the ester is equal to or greater than 16 and that at least one of the hydrocarbon radicals in the ester has 12 or more carbon atoms; and 3. mixtures thereof.

B. from 0.1% to about 25% by weight of the suds regulating system of a hydrophobic silica suds regulating agent.

2. The composition in accordance with claim 1 wherein the mixture of the liquid hydrocarbon and the

| INGREDIENTS | EXAMPLES XII | XIII | XIV |
|---|---|---|---|
| Linear dodecylbenzene sulfonic acid sodium salt | 1 | 1 | 10 |
| Condensate of branched (72%) fatty alcohol having from 16 to 19 carbon atoms in the alkyl chain, and 11 moles of ethylene oxide | 6 | — | 10 |
| Condensate of branched (60%) fatty alcohol having from 12 to 15 carbon atoms in the alkyl chain, and 4 moles of ethylene oxide | 8 | 9 | — |
| Condensate of $C_{14-15}$ alcohol blend, molar ratio:$C_{14}$:$C_{15}$ = 1:1, with 7 moles of ethylene oxide per mole of alcohol | — | 10 | — |
| Sodium perborate $4H_2O$ | 20 | 10 | 30 |
| Proteolytic enzyme | 1 | 1 | — |
| Sodiumtripolyphosphate | — | 6 | 10 |
| Sodiumpyrophosphate | 20 | — | — |
| Sodiumorthophosphate | — | 12 | — |
| Water-insoluble alumo-silicate builder(5) | 20 | 15 | 10 |
| Sodium sulfate | 10 | 20 | 15 |
| Paraffin oil | 1.0 | 0.5 | 1.5 |
| Paraffin MP:52°-54° C. | 0.1 | — | 0.2 |
| MP:85° C. | — | 0.02 | — |
| Glycerol monostearate | 0.4 | 0.25 | 0.4 |
| Hydrophobic silica | 0.03 | 0.01 | 0.02 |

adjunct material represents from about 99.5 to about 90% by weight of the suds regulating system.

3. The composition in accordance with claim 2 wherein the adjunct material is represented by the solid hydrocarbon.

4. The composition in accordance with claim 3 wherein the hydrocarbon adjunct material represents from about 40% to about 2% by weight and the liquid hydrocarbon represents from about 60% to about 98% by weight, both percentages being expressed by reference to the mixture of the liquid hydrocarbon and the hydrocarbon adjunct material.

5. The composition in accordance with claim 4 wherein the hydrophobic silica suds regulating agent represents from about 0.5% to about 10% by weight of the suds regulating system.

6. The composition in accordance with claim 2 wherein the adjunct material is the fatty ester.

7. The composition in accordance with claim 6 wherein the fatty ester adjunct material represents from about 70% to about 10% by weight and the liquid paraffin from about 30% to about 90% by weight, both percentages being expressed by reference to the mixture of the liquid paraffin and the fatty ester adjunct material.

8. The composition in accordance with claim 7 wherein the hydrophobic silica is present in a level of from about 0.5% to about 10% by weight of the suds regulating system.

9. The composition in accordance with claim 1 which additionally comprises from about 3% to about 50% by weight of a detergent builder.

10. The composition in accordance with claim 9 wherein the organic surface-active agent represents from about 3% to about 50% by weight.

11. The composition in accordance with claim 10 wherein the adjunct material is represented by a mixture of the adjunct solid hydrocarbon and the adjunct fatty ester in a weight ratio of hydrocarbon to ester from 1:20 to 1:1.

12. The composition in accordance with claim 1 which additionally contains from about 3% to about 50% by weight of a detergent peroxybleach component.

13. The composition in accordance with claim 12 wherein the organic surface-active agent is selected from anionic and/or nonionic surfactants which are present in a level from about 5% to about 20% by weight.

14. The composition in accordance with claim 13 wherein the hydrophobic silica has an average primary particle diameter from about 5 millimicrons to about 100 millimicrons.

15. The composition in accordance with claim 14 wherein the adjunct material is represented by a mixture of the adjunct solid hydrocarbon and the adjunct fatty ester in a weight ratio of hydrocarbon to fatty ester in the range from 1:2 to 1:10.

16. The composition in accordance with claim 2 wherein the adjunct material is selected from the group consisting of: beeswax; carnauba wax; spermaceti; stearyl acetate; palmityl di-lactate; cocoyl isobutyrate; oleyl maleate; olyl di-maleate; tallowylpropionate; xylitol monopalmitate; pentaerythritol monostearate; sucrose monostearate; ethylene glycol monostearate; sorbitan monostearate; sorbitan monomyristate; sorbitan monobehenate; sorbitan di-stearate; sorbitan di-myristate; sorbitan di-behenate and sorbitan di-oleate.

17. A composition in accordance with claim 1 wherein the components of the suds regulating system are agglomerated with part or all of the surface-active agent before being mixed with the detergent base-powder.

* * * * *